US007690815B2

(12) United States Patent
Dallas et al.

(10) Patent No.: US 7,690,815 B2
(45) Date of Patent: Apr. 6, 2010

(54) PORTABLE LIGHTING DEVICE

(75) Inventors: Edgar A. Dallas, Beaverton, OR (US); Steve Rohman, Portland, OR (US)

(73) Assignee: Fiskars Brands, Inc., Madison, WI (US)

( * ) Notice: Subject to any disclaimer, the term of this patent is extended or adjusted under 35 U.S.C. 154(b) by 306 days.

(21) Appl. No.: 11/771,674

(22) Filed: Jun. 29, 2007

(65) Prior Publication Data

US 2009/0002992 A1 Jan. 1, 2009

(51) Int. Cl.
*F21V 9/00* (2006.01)

(52) U.S. Cl. ..... 362/293; 362/202; 362/319; 362/208; 362/280

(58) Field of Classification Search ..... 362/293, 362/202, 319, 208, 280
See application file for complete search history.

(56) References Cited

U.S. PATENT DOCUMENTS

| | | | | |
|---|---|---|---|---|
| 1,241,771 | A | 10/1917 | Schram | |
| 1,443,106 | A | 1/1923 | Walsh | |
| 2,296,005 | A | 9/1942 | Weiner | |
| 2,347,531 | A | 4/1944 | Yardeny | |
| 2,389,591 | A | 11/1945 | Brown | |
| 3,936,147 | A | 2/1976 | Murakami | |
| 3,936,164 | A | 2/1976 | Cohen et al. | |
| 4,202,601 | A | 5/1980 | Burbo et al. | |
| 4,346,329 | A | 8/1982 | Schmidt | |
| 4,517,628 | A | 5/1985 | McDermott | |
| 4,580,196 | A | 4/1986 | Task | |
| 4,677,533 | A | 6/1987 | McDermott et al. | |
| 4,697,890 | A | 10/1987 | Crookston | |
| 4,947,291 | A | 8/1990 | McDermott | |
| 4,963,798 | A | 10/1990 | McDermott | |
| 5,037,346 | A | 8/1991 | Cimock | |
| 5,161,879 | A | 11/1992 | McDermott | |
| 5,402,326 | A * | 3/1995 | Belliveau | 362/284 |
| 5,581,356 | A | 12/1996 | Vezard | |
| 5,617,080 | A | 4/1997 | Morich | |
| RE36,197 | E | 4/1999 | Walker | |
| 5,896,189 | A | 4/1999 | Watkins | |
| 6,061,591 | A | 5/2000 | Freitag et al. | |
| RE37,136 | E | 4/2001 | Vezard | |
| 6,366,028 | B1 * | 4/2002 | Wener et al. | 315/241 P |
| 6,957,905 | B1 * | 10/2005 | Pritchard et al. | 362/554 |
| 7,048,408 | B2 * | 5/2006 | Dallas et al. | 362/202 |
| 7,178,937 | B2 * | 2/2007 | McDermott | 362/187 |

OTHER PUBLICATIONS

Color Photographs of Playskool® flashlight, the flashlight believed to have been available prior to Jul. 30, 2003, 4 pages.

* cited by examiner

*Primary Examiner*—Sandra L O'Shea
*Assistant Examiner*—Jessica L McMillan
(74) *Attorney, Agent, or Firm*—Foley & Lardner LLP

(57) ABSTRACT

The present invention relates to a portable lighting device comprising a body, a light source coupled to the body and configured to emit a beam of light along a central axis, a head assembly rotatably coupled to the body, and a filter assembly rotatably coupled to the body. The filter assembly has a rotational axis and a plurality of filters offset from the central axis. Rotation of the head assembly rotates the filter assembly to align different filters of the plurality of filters along the central axis on an output side of the light source.

25 Claims, 4 Drawing Sheets

PORTABLE LIGHTING DEVICE

BACKGROUND OF THE INVENTION

The present invention relates to a portable lighting device with a colored lens. More particularly, the present invention relates to a portable lighting device with a mechanically selectable colored lens providing focused filtered LED light.

Portable lighting devices, such as flashlights, are common. A typical flashlight includes one or more batteries arranged within a cylindrical battery compartment that forms the handle of the light. A front end, or head, typically houses a bulb or lamp. A switch mechanism, generally placed between the lamp and the batteries, controls the flow of electricity between the batteries and the lamp. Current portable lighting devices are offered in a multitude of shapes and sizes and provide many options for a variety of disciplines including but not limited to: military; fire fighting; police; industry; camping; boating; outdoor sports; scuba; hunting; and general household use.

The need for a focused high powered beam of colored filtered light is common among hunters, astronomers, and military and security personnel engaged in various operations. It is desirable in these applications for the filter mechanism to be simple to operate so as not to interfere with the task at hand. Also, colored filtered light is preferable to white light in many of these applications in that it helps preserve the night vision of the user and nearby individuals. Additionally, filtered light may be more difficult to detect by observers. High powered light emitting diodes (LEDs) may be preferable in these applications as they consume less power than conventional incandescent bulbs, therefore lasting hundreds of hours on a set of conventional batteries, as compared to a few dozen hours for incandescent bulbs. Additionally, LED flashlights are often electronically regulated to maintain a constant light output as batteries fade. By contrast, a standard flashlight using normal light bulbs emits a progressively dimmer output, sometimes spending much of the total running time below optimum brightness level.

One way of providing colored filtered light is to provide translucent lenses in various colors that the user may insert in place of a transparent bulb cover. However, changing the filter color of the light requires disassembly and reassembly. This may be difficult to accomplish in the dark, and may be a slow, time-consuming process. Also, disassembly increases the chances of dropping and possibly losing critical parts during the exchange process. Having loose parts necessitates storage when the light is not in use.

Another approach to providing colored filtered light is to use independent lamps or bulbs, each of a different color or with a separate color filter. However, the use of multiple bulbs increases the number of component parts and raises the cost of manufacturing. Additionally, the control of multiple light sources may require more user inputs, or more complex electronic switching to take advantage of the separate bulbs.

Yet another approach to providing a variable color light source is to use a single lamp, or bulb, and a wheel fitted with a variety of colored filters. The color wheel may be fitted over the lamp and rotated to provide colored filtered light. However, in this instance, the filtered light does not pass through a lens to provide a focused beam of light.

Therefore, there is a need for a portable lighting device to emit a beam of colored filtered light that is simple to operate and easily changeable by the user. There is also a need for a portable lighting device that can provide a focused beam of light at the output of a colored filter. There is still another need for a portable lighting device that can provide a high powered focused beam of light at the output of a colored filter.

SUMMARY OF THE INVENTION

One embodiment of the invention relates to a portable lighting device comprising a body having a central axis, a light source coupled to the body and configured to emit a beam of light along a central axis, and a head assembly rotatably coupled to the body along the central axis. The head assembly comprises a ring gear coupled to the head assembly along the central axis. The portable lighting device further comprises a filter assembly rotatably coupled to the body and having a rotational axis offset from the central axis. The filter assembly comprises a plurality of filters and a pinion gear interlocked with the ring gear. Rotation of the head assembly rotates the ring gear, thereby rotating the pinion gear to selectively align different filters of the plurality of filters along the central axis on an output side of the light source.

Another embodiment of the invention relates to a portable lighting device comprising a body, a light source coupled to the body and configured to emit a beam of light along a central axis, a head assembly rotatably coupled to the body, and a filter assembly rotatably coupled to the body. The filter assembly has a rotational axis and a plurality of filters offset from the central axis. Rotation of the head assembly rotates the filter assembly to align different filters of the plurality of filters along the central axis on an output side of the light source.

A further embodiment of the invention relates to a portable lighting device comprising a body, a light source coupled to the body and configured to emit a beam of light along a central axis, a head rotatably coupled to the body, a filter assembly rotatably coupled to the body having a plurality of filters, and a means for rotating the filter assembly about an axis offset from the central axis.

DESCRIPTION

Figure 1:
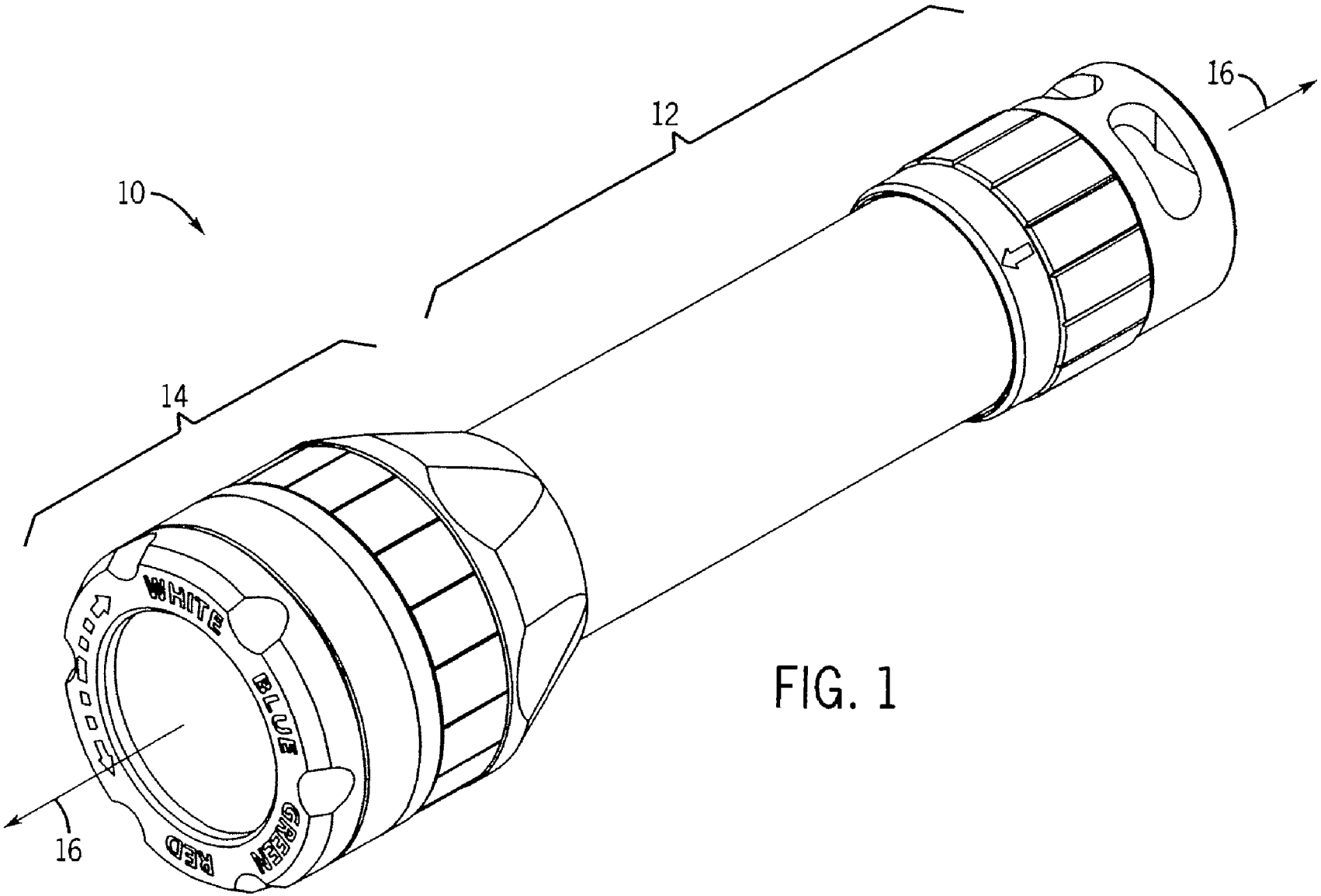
FIG. 1 is a perspective view of a portable lighting device equipped with a lighting filter mechanism according to an exemplary embodiment.

Referring to FIG. 1, a portable lighting device, shown as a flashlight 10, is illustrated in an exemplary embodiment. Flashlight 10 includes a body 12 and a head assembly 14. Flashlight 10 is centered on a central axis, shown as longitudinal axis 16.

Body 12 may be cylindrical or other shape and may be made of metal, plastic, or other materials. Body 12 may contain batteries or other power source as well as additional internal wiring or a switch, which may be embodied in a variety of types and configurations as is generally known in the art. Body 12 is centered on longitudinal axis 16.

Figure 2:
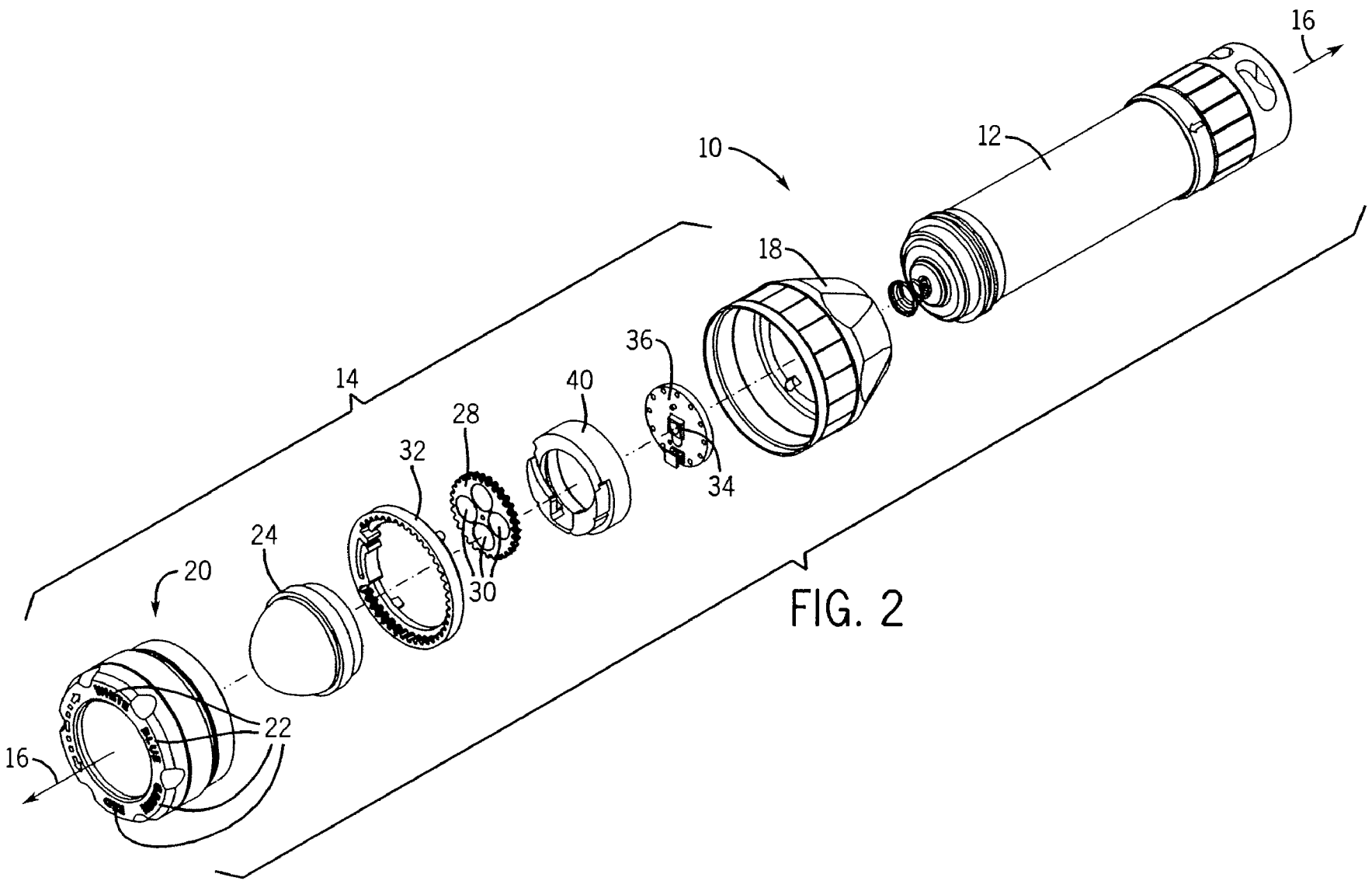
FIG. 2 is an exploded perspective view of a portable lighting device equipped with a lighting filter mechanism according to an exemplary embodiment.

In the embodiment shown in FIG. 2, head assembly 14 may include a housing 18, a head shown as lens assembly 20, and a connector 40. Connector 40 may be provided with a threaded connection to rotationally couple head assembly 14 to body 12. In alternative embodiments, body 12 and head assembly 14 may be a single integral piece, secured with adhesive, snapped into position, or otherwise fastened. Connector 40 is designed to be rigidly coupled to body 12 yet allow head assembly 14 to rotate in either a clockwise or counter-clockwise direction relative to body 12. According to the embodiment shown in FIG. 2, connector 40 rotationally couples housing 18 to body 12. Also according to the embodiment shown is FIG. 2, lens assembly 20 is secured to housing 18. This allows both housing 18 and lens assembly 20 to rotate relative to body 12 about longitudinal axis 16. Housing 18, lens assembly 20, and connector 40 may be made of metal, plastic, or other materials, and centered on longitudinal axis 16.

Referring still to FIG. 2, lens assembly 20 may be provided with a variety of alignment mechanisms. The user may rotate lens assembly 20 to a known position utilizing markings or indicators 22 on lens assembly 20. The indicators 22 may be displayed in the form of lettering, raised dots, grooves, or depressions that provide the user with a tactile or visual indicator of the rotational position of lens assembly 20. In another exemplary embodiment, the user may be provided with positive tactile feedback by an indexing mechanism, such as that described in U.S. Pat. No. 7,048,408 "Lighting Head Mechanism and Filter" to Dallas et al.

Referring still to FIG. 2, lens assembly 20 may house a secondary optic or a reflector, shown as focusing device 24. Lens assembly 20 is coupled to housing 18 to help prevent light leakage and ensure that the light emanating from flashlight 10 passes through focusing device 24 to be collimated. Focusing device 24 may be any type of refractive lens or reflective mirror. In an exemplary embodiment, focusing device 24 may be a ball optical lens. In an alternative embodiment, focusing device 24 may be a parabolic reflector. Focusing device 24 may be made of glass, polycarbonate, or other materials and centered on longitudinal axis 16.

Figure 3:
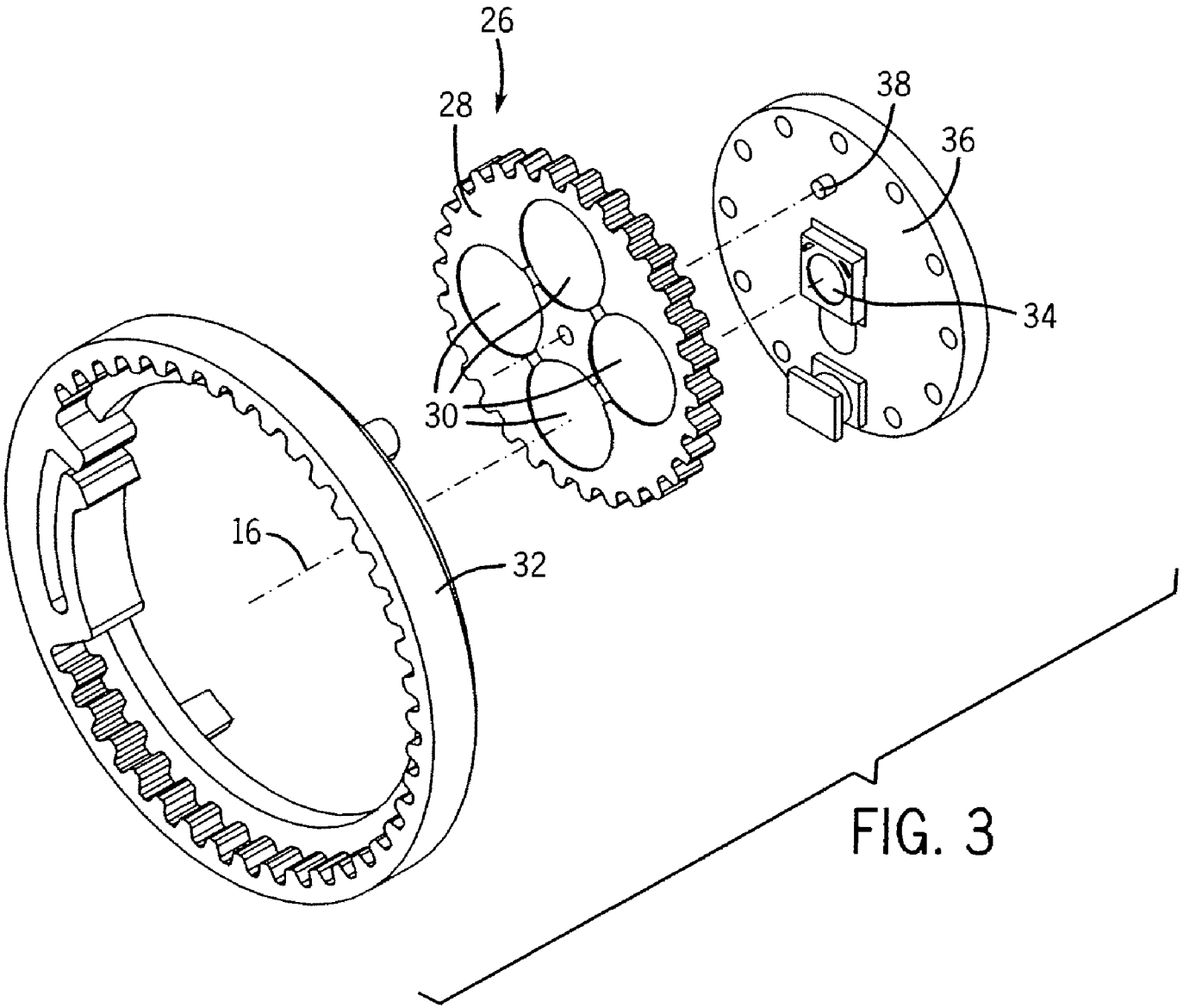
FIG. 3 is an exploded perspective view of a filter assembly, for use in the portable lighting device illustrated in FIG. 1 according to an exemplary embodiment.

Referring to FIGS. 2 and 3, an internal gear, shown as ring gear 32, a filter assembly 26, shown as pinion gear filter plate 28, a light source 34, and a circuit board 36 are shown. In FIGS. 2 and 3, filter assembly 26 and light source 34 are shown coupled to circuit board 36. In an alternative embodiment, filter assembly 26 and light source 34 may be coupled to body 12. Circuit board 36 may be rigidly coupled to body 12 by connector 40. In an exemplary embodiment, light source 34 is a high powered light emitting diode (LED). In alternative embodiments, light source 34 may be a conventional bulb, such as an incandescent, halogen, or krypton bulb, or any other source of light. If other bulb types are used, the light source 34 may be connected to a light mount (not shown) by a threaded connection, a bayonet connection, or other connection types as are known to the art. The light mount may further contain mounting posts, electronic controls, battery terminals, switches, or any method of support or control required by an alternate light source 34.

Figure 4:
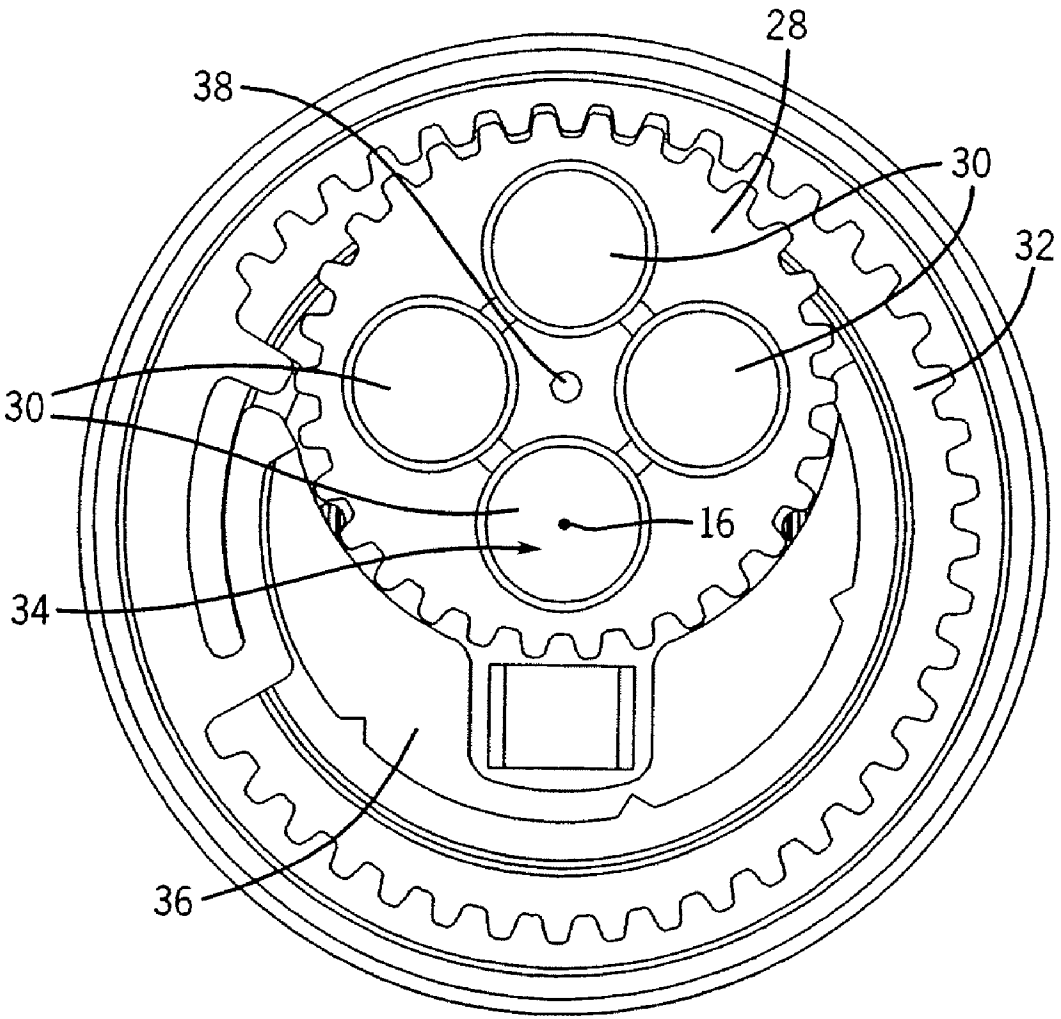
FIG. 4 is a front view of a lighting filter assembly, for use in the portable lighting device illustrated in FIG. 1 according to an exemplary embodiment.

Referring to FIGS. 2, 3, and 4, ring gear 32 may be fixed to housing 18 and interlocked with pinion gear filter plate 28. In an alternative embodiment, ring gear 32 may be coupled to head assembly 14. Pinion gear filter plate 28 may be rotatably coupled to circuit board 36 at rotating lens pivot 38 and may be located between light source 34 and focusing device 24. In an exemplary embodiment, rotating lens pivot 38 and longitudinal axis 16 are offset from one another. Pinion gear filter plate 28 may contain a plurality of lenses or filters 30. Pinion gear filter plate 28 may be positioned on the output side of light source 34 such that one of the filters 30 is directly in front of light source 34. The filters 30 may be clear, colored, and/or polarized. Additionally, the filters 30 may be configured to selectively transmit various non-visible ultraviolet or infrared spectrums of light. In an exemplary embodiment, the pinion gear filter plate 28 contains four filters 30 (e.g. red, white, blue, and green). The number, color, size and type of filters 30 may be varied with the needs of the user. For example, pinion gear filter plate 28 may contain 2, 3, 5 or more filters 30.

A user may readily switch flashlight 10 between available filter positions. In operation, a user may rotate head assembly 14 of flashlight 10 about longitudinal axis 16. Rotation of head assembly 14 rotates ring gear 32, also about longitudinal axis 16. Rotation of ring gear 32 causes pinion gear filter plate 28 to rotate about rotating lens pivot 38, allowing the different available filters 30 to be selectively aligned or placed on the output side of light source 34.

The user may detect a positive tactile feedback as leaf springs and a detent mechanism engage in notches on the filter assembly 26, ensuring that the chosen filter 30 will be placed in proper position to allow an unobstructed pathway from light source 34 to the environment. The user may further use the indicators 22 on the face of the lens assembly 20 to place the lens assembly 20 in a known position. As these procedures do not necessarily rely on any visual cues, the user may perform color selection even in conditions of total darkness. Once the lens assembly is in a known position, other filters 30 may be selected by rotation of lens assembly 20 a predetermined number of steps to the right or left, as indicated by tactile feedback from the detent mechanism. Additional tactile cues may be provided on the lens assembly 20 or the housing 18 to further specify the precise rotational position of the lens assembly 20 during operation.

In other exemplary embodiments, flashlight 10 may be another type of portable lighting device such as a headlamp or lantern.

According to an exemplary embodiment, the present invention provides a high powered beam of colored and/or filtered light along a central axis of a portable lighting device. Additionally, the present invention allows for quick and easy selection of a variety of colors and/or filters, with no need to store loose, additional parts. Additionally, the present invention allows all internal rotating components to be housed within the portable lighting device and not exposed on the outside of the portable lighting device.

According to an exemplary embodiment, the present invention provides an improved light output form as the light source is an LED or a high powered LED. The location of the LED on a central axis allows for the placement of circuit boards and/or heat sinks. Additionally, the central axis location of the LED allows for the collection of light and a focused beam. The beam of light is filtered before it is received by an optical lens or reflector.

It is important to note that the construction and arrangement of the portable lighting device shown and described in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes, and proportions of the orientations, etc.) without materially departing from the novel teachings and advantages of the subject matter recited in the description. For example, elements shown as integrally formed may be constructed of multiple parts or elements, the position of elements may be reversed or otherwise varied, and the nature or number of discrete elements or positions may be altered or varied. Other substitutions, modifications, changes, and omissions may be made in the design, operating conditions and arrangement of the exemplary embodiments without departing from the scope of the invention as expressed in the appended claims.

What is claimed is:

1. A portable lighting device, comprising:

a body having a central axis;

a light source coupled to the body, the light source configured to emit a beam of light along the central axis;

a head assembly rotatably coupled to the body along the central axis, the head assembly comprising a ring gear coupled to the head assembly along the central axis; and a filter assembly rotatably coupled to the body and having a rotational axis offset from the central axis, the filter assembly comprising a plurality of filters and a pinion gear interlocked with the ring gear;

wherein rotation of the head assembly rotates the ring gear, thereby rotating the pinion gear to selectively align different filters of the plurality of filters along the central axis on an output side of the light source.

2. The portable lighting device of claim 1, further comprising a focusing device on an output side of the light source.

3. The portable lighting device of claim 2, wherein the beam of light is filtered by one of the plurality of filters prior to being focused by the focusing device.

4. The portable lighting device of claim 2, wherein the focusing device is a reflector.

5. The portable lighting device of claim 1, wherein the light source is a high power LED.

6. The portable lighting device of claim 5, further comprising a circuit board coupled to the body, wherein the high powered LED is coupled to the circuit board.

7. The portable lighting device of claim 1, wherein the portable lighting device is a headlamp.

8. The portable lighting device of claim 1, wherein the portable lighting device is a lantern.

9. A portable lighting device, comprising:

a body;

a light source coupled to the body, the light source configured to emit a beam of light along a central axis;

a head assembly rotatably coupled to the body; and a filter assembly rotatably coupled to the body and comprising a plurality of filters, the filter assembly having a rotational axis offset from the central axis;

wherein rotation of the head assembly rotates the filter assembly to align different filters of the plurality of filters along the central axis on an output side of the light source.

10. The portable lighting device of claim 9, wherein the filter assembly comprises a pinion gear and further comprising:

a ring gear fixed to the head assembly and interlocked with the pinion gear;

wherein rotation of the head assembly rotates the ring gear, thereby rotating the pinion gear to selectively place the different filters of the plurality of filters on the output side of the light source.

11. The portable lighting device of claim 9, further comprising a focusing device on an output side of the light source.

12. The portable lighting device of claim 11, wherein the beam of light is filtered by one of the plurality of filters prior to being focused by the focusing device.

13. The portable lighting device of claim 11, wherein the focusing device is a reflector.

14. The portable lighting device of claim 9, wherein the light source is a high power LED.

15. The portable lighting device of claim 14, further comprising a circuit board coupled to the body, wherein the high powered LED is coupled to the circuit board.

16. The portable lighting device of claim 9, wherein the portable lighting device is a headlamp.

17. The portable lighting device of claim 9, wherein the portable lighting device is a lantern.

18. The portable lighting device of claim 9, wherein all internal rotating components are housed within the portable lighting device.

19. A portable lighting device, comprising:

a body;

a light source coupled to the body, the light source configured to emit a beam of light along a central axis;

a head rotatably coupled to the body;

a filter assembly rotatably coupled to the body, the filter assembly having a plurality of filters; and a means for rotating the filter assembly about an axis offset from the central axis.

20. The portable lighting device of claim 19, wherein rotation of the head rotates the means for rotating the filter assembly, thereby selectively aligning different filters of the plurality of filters on an output side of the light source.

21. The portable lighting device of claim 19, further comprising a focusing device on an output side of the light source.

22. The portable lighting device of claim 21, wherein the beam of light is filtered by one of the plurality of filters prior to being focused by the focusing device.

23. The portable lighting device of claim 21, wherein the light source is a high power LED.

24. The portable lighting device of claim 23, further comprising a circuit board coupled to the body, wherein the high powered LED is coupled to the circuit board.

25. The portable lighting device of claim 21, wherein the means for rotating the filter assembly about an axis offset from the central axis is a ring gear interlocked with a pinion gear.

* * * * *